US006834475B2

(12) United States Patent
Trebbi et al.

(10) Patent No.: US 6,834,475 B2
(45) Date of Patent: Dec. 28, 2004

(54) CAPSULE FILLING MACHINE

(75) Inventors: Roberto Trebbi, Castenaso (IT); Salvatore Fabrizio Consoli, Bologna (IT)

(73) Assignee: I.M.A. Industria Macchine Automatiche S.p.A., Ozzano Emilia (IT)

( * ) Notice: Subject to any disclaimer, the term of this patent is extended or adjusted under 35 U.S.C. 154(b) by 0 days.

(21) Appl. No.: 10/480,804

(22) PCT Filed: May 12, 2003

(86) PCT No.: PCT/IB03/01906

§ 371 (c)(1),
(2), (4) Date: Dec. 19, 2003

(87) PCT Pub. No.: WO03/094825

PCT Pub. Date: Nov. 20, 2003

(65) Prior Publication Data

US 2004/0163365 A1 Aug. 26, 2004

(30) Foreign Application Priority Data

May 14, 2002 (IT) ..... BO2002A0284

(51) Int. Cl.[7] ..... B65B 1/10
(52) U.S. Cl. ..... 53/253; 53/281; 53/900
(58) Field of Search ..... 53/253, 281, 282, 53/900

(56) References Cited

U.S. PATENT DOCUMENTS 3,078,629 A * 2/1963 Besemer et al. ..... 53/282
4,731,979 A 3/1988 Yamamoto et al.
4,782,644 A * 11/1988 Haarer et al. ..... 53/282
4,959,943 A * 10/1990 Yamamoto et al. ..... 53/900
5,018,335 A * 5/1991 Yamamoto et al. ..... 53/900

* cited by examiner

*Primary Examiner*—John Sipos
(74) *Attorney, Agent, or Firm*—Arent Fox

(57) ABSTRACT

A capsule filling machine (1) for the production of hard gelatine capsules (C) of the type with a capsule lid and a capsule body and containing a product, preferably a pharmaceutical product, comprises at least a first station (2), rotating with a stepping motion, for supporting and moving at least one capsule body (3) to a second station (4) for feeding and dosing the product, the second station (4) rotating with a stepping motion synchrozised with that of the first station (2) and having at least one cylindrical hole (5) containing a dose (6) of the product; between the first station (2) and the second station (4) there being slide means (7) for supporting and moving the capsule body (3) between a first operating position, in which the capsule body (3) is distanced from a lower end (5*a*) of the cylindrical hole (5), and a second operating position, in which the capsule body (3) is exactly below the lower end (5*a*) of the cylindrical hole (5), allowing the dose of product (6) to be released into the capsule body (3); the slide means (7) comprising a first and a second support (8, 9) operating in conjunction with one another, the first support (8) being carried by the first station (2), rotating and supporting a capsule body (3); the second support (9) being carried by the second station (4), rotating and, in the first operating position, located below the end (5*a*) of the cylindrical hole (5) to close the end (5*a*); there also being drive means (10) acting on at least the first support (8) to move the first support (8) towards the second support (9) with both radial and transversal motion until the first support (8) gradually makes contact with the second support (9), with a consequent thrust by the first support (8) on the second support (9) pushing the second support (9) back away from the first operating position to the second operationg position, allowing the dose (6) to be released into the capsule body (3).

5 Claims, 5 Drawing Sheets

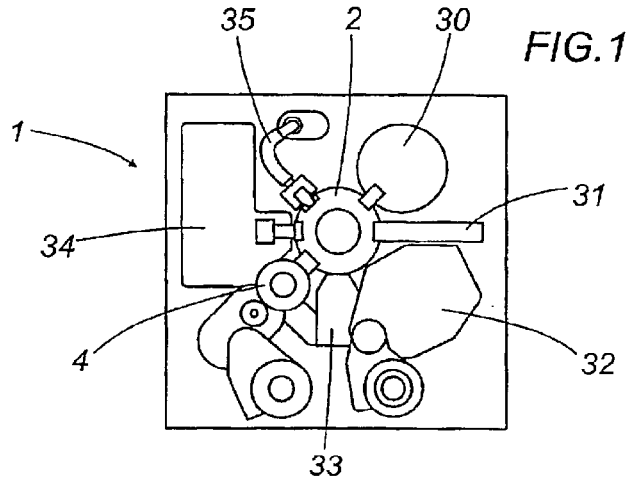
FIG.1
FIG.2
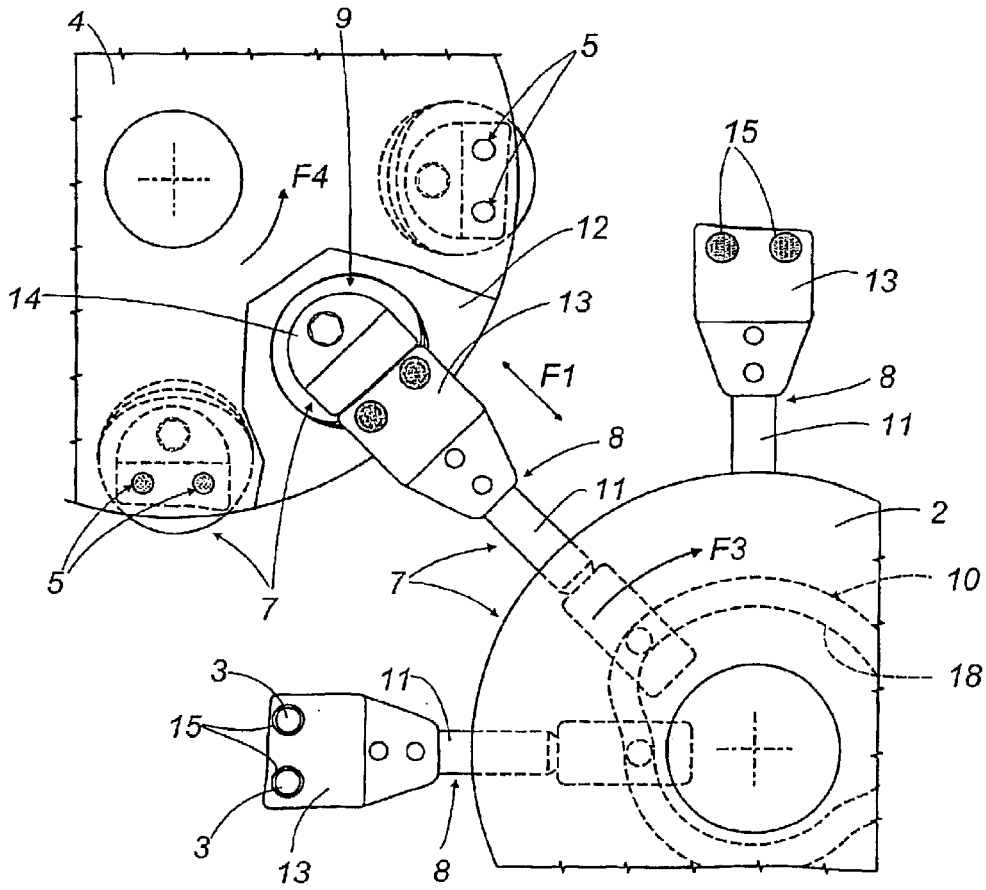

CAPSULE FILLING MACHINE

CROSS-REFERENCE TO RELATED APPLICATION

This application is a National Stage entry of International Application No. PCT/IB03/01906, filed May 12, 2003, the entire specification claims and drawings of which are incorporated herewith by reference.

TECHNICAL FIELD

The present invention relates to a capsule filling machine for the production of hard gelatine capsules containing products, preferably pharmaceutical products.

In particular, the pharmaceutical products contained in hard gelatine capsules of the type with a capsule lid and a capsule body to which this text refers are products which are powdered or made from powdered material, such as tablets, micro-tablets or "pellets", or liquid products.

BACKGROUND ART

Generally speaking, a capsule filling machine of the known type currently used basically comprises a central turret, rotating with intermittent or stepping motion, with a plurality of operating units arranged along the edge of the turret and driven by the turret by means of reciprocating drive parts.

Each turret operating unit comprises a support element in the form of a slide which holds one or more capsules to be carried, with the above-mentioned stepping motion, to a plurality of work stations in which successive operating steps take place, according to a known method, such as feeding and angled positioning of the closed capsules, the subsequent opening of each capsule, that is to say, separation of the capsule body from the capsule lid, feeding of a quantity of pharmaceutical product into the capsule body, then closing of each capsule body with the relative capsule lid and, finally, ejection of the closed, filled capsule obtained in this way.

The above-mentioned pharmaceutical product is fed using an operating station consisting of a hopper containing the product, which feeds a rotary drum which has a plurality of cylindrical product dosing holes.

The synchronised stepping rotation of the turret relative to the drum allows the capsule slide support carried on the turret to move opposite the corresponding cylindrical dosing hole in the drum which already holds a dose of product compressed by a piston or pounder.

At this point during the turret dwell period, the slide with the capsule body is moved forward with a radial movement of the turret towards the drum, so that it is positioned under the cylindrical hole and in a feed position, that is to say, so that the dose is released into the capsule body. Then the slide support moves back, again radially towards the central turret, to move clear of the drum, then the turret turns forward one step for the subsequent operating steps.

However, product feed according to the above-mentioned method currently has several disadvantages, in particular due to the mechanical complexity of the slide support radial linear movement from and towards the cylindrical dosing hole in the drum.

The slide support linear movement requires a transition time between slide positioning and the arrival of the cylindrical hole with the quantity of product which is mechanically difficult to achieve and necessitates slide supports with very long operating strokes.

Moreover, in many cases product losses occur, particularly around the seats or bushes which hold the capsule bodies on the slide support, resulting in friction which damages the slide supports and may cause unwanted rotary turret and, consequently, capsule filling machine stops.

DISCLOSURE OF THE INVENTION

The aim of the present invention is, therefore, to overcome the above-mentioned disadvantages in the prior art.

Accordingly the present invention provides a capsule filling machine for the production of hard gelatine capsules of the type with a capsule lid and a capsule body and containing a product, preferably a pharmaceutical product. The machine comprises at least a first rotary station with a stepping motion for supporting and moving at least one capsule body to a second, product feed and dosing station, the second station rotating with a stepping motion synchronised with the first station, and having at least one cylindrical hole containing a dose of the product. Between the first station and the second station there are slide means for supporting and moving the capsule body between a first operating position, in which the capsule body is distanced from a lower end of the cylindrical hole, and a second, operating position, in which the capsule body is exactly below the lower end of the cylindrical hole, allowing the dose of product to be released into the capsule body. The machine is characterised in that the slide means comprise at least a first and at least a second support which operate in conjunction with one another. The first support is carried by the first rotary station and supports at least one capsule body. The second support is carried by the second rotary station and is positioned, in the first operating position, below the end of the cylindrical hole containing the dose, closing the end. There are drive means designed to operate on at least the first support, so that the first support moves forward towards the second support with both radial and transversal motion, until the first support gradually makes contact with the second support, the first support consequently pushing on the second support in such a way that the second support moves backwards from the first operating position to the second operating position, allowing the dose to be released into the capsule body.

BRIEF DESCRIPTION OF THE DRAWINGS

The technical features of the present invention are apparent in the claims herein, and the advantages are more clearly described in the detailed description below, with reference to the accompanying drawings, which illustrate a preferred embodiment of the invention, without limiting the scope of its application, and in which:

FIG. 1 is a schematic plan view with some parts cut away for greater clarity, of a preferred embodiment of a capsule filling machine;

FIG. 2 is an enlarged schematic top plan view of a detail of the capsule filling machine illustrated in FIG. 1;

DETAILED DESCRIPTION OF THE PREFERRED EMBODIMENTS OF THE INVENTION

With reference to the accompanying drawings, and in particular with reference to FIG. 1, the intermittent capsule filling machine disclosed, labelled 1 as a whole, is used to produce capsules with two parts, of the type with a capsule lid and a capsule body, containing pharmaceutical products which are powdered or made from powdered material, such as tablets, micro-tablets or "pellets", or liquid products.

The machine 1 is preferably, but without limiting its scope of application, advantageously used for the production of capsules in limited quantities for experimental purposes in order to test the validity of products before large-scale production.

Figure 3:
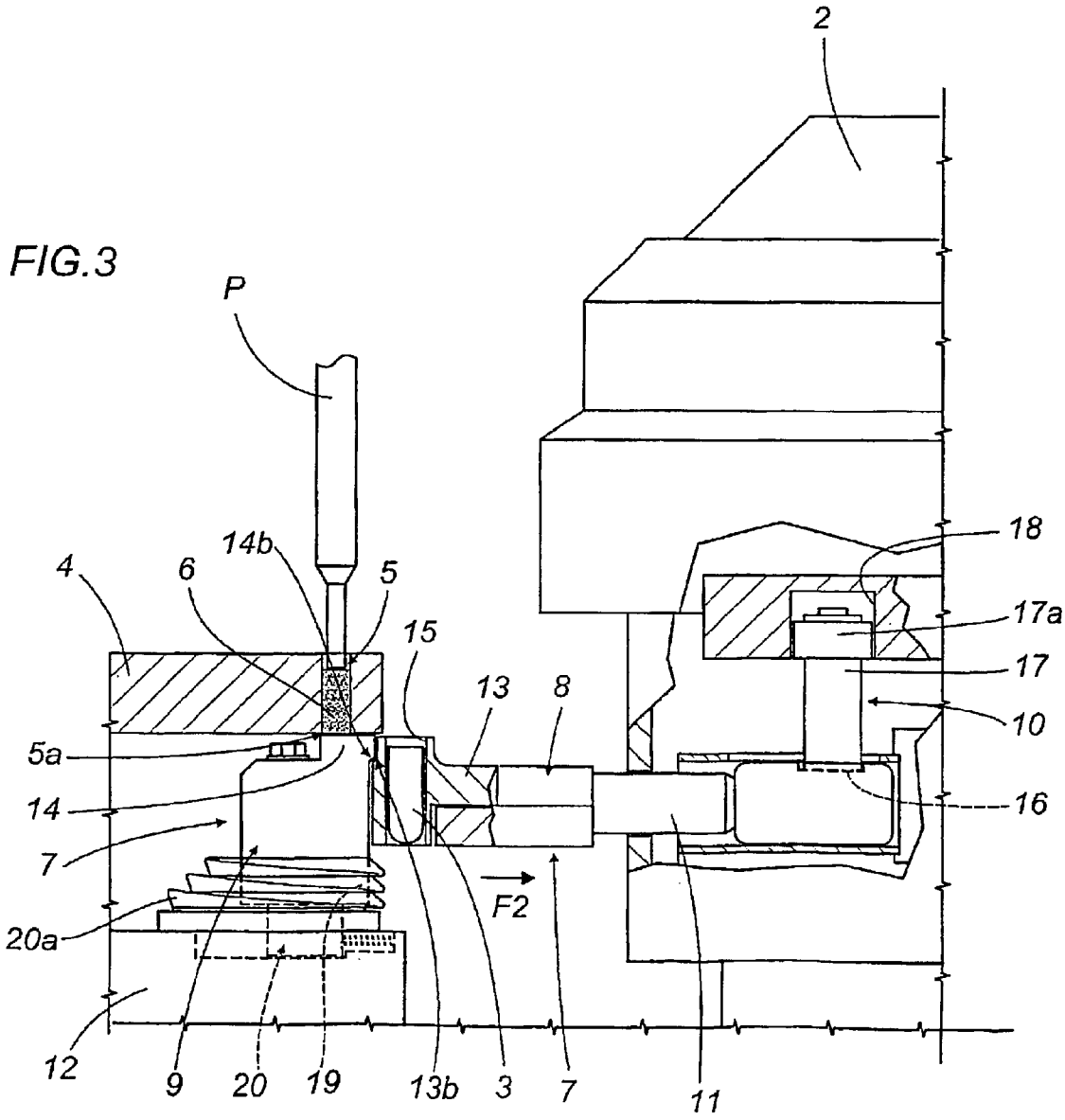
FIGS. 3 and 4 are side views with some parts in cross-section and other parts cut away for greater clarity, of the part of the machine illustrated in FIG. 2 in two different operating configurations.
Figure 4:
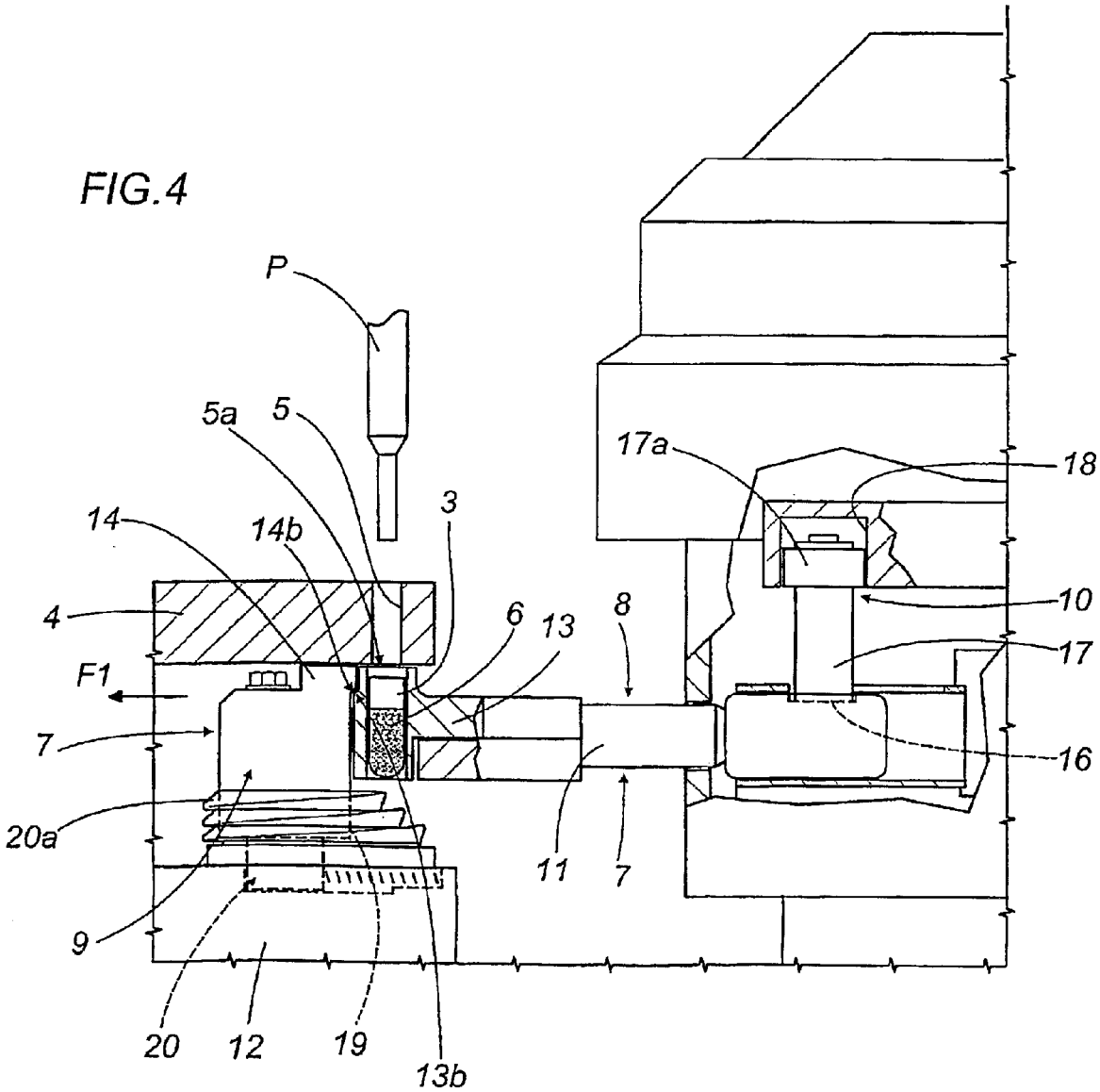
Figure 5:
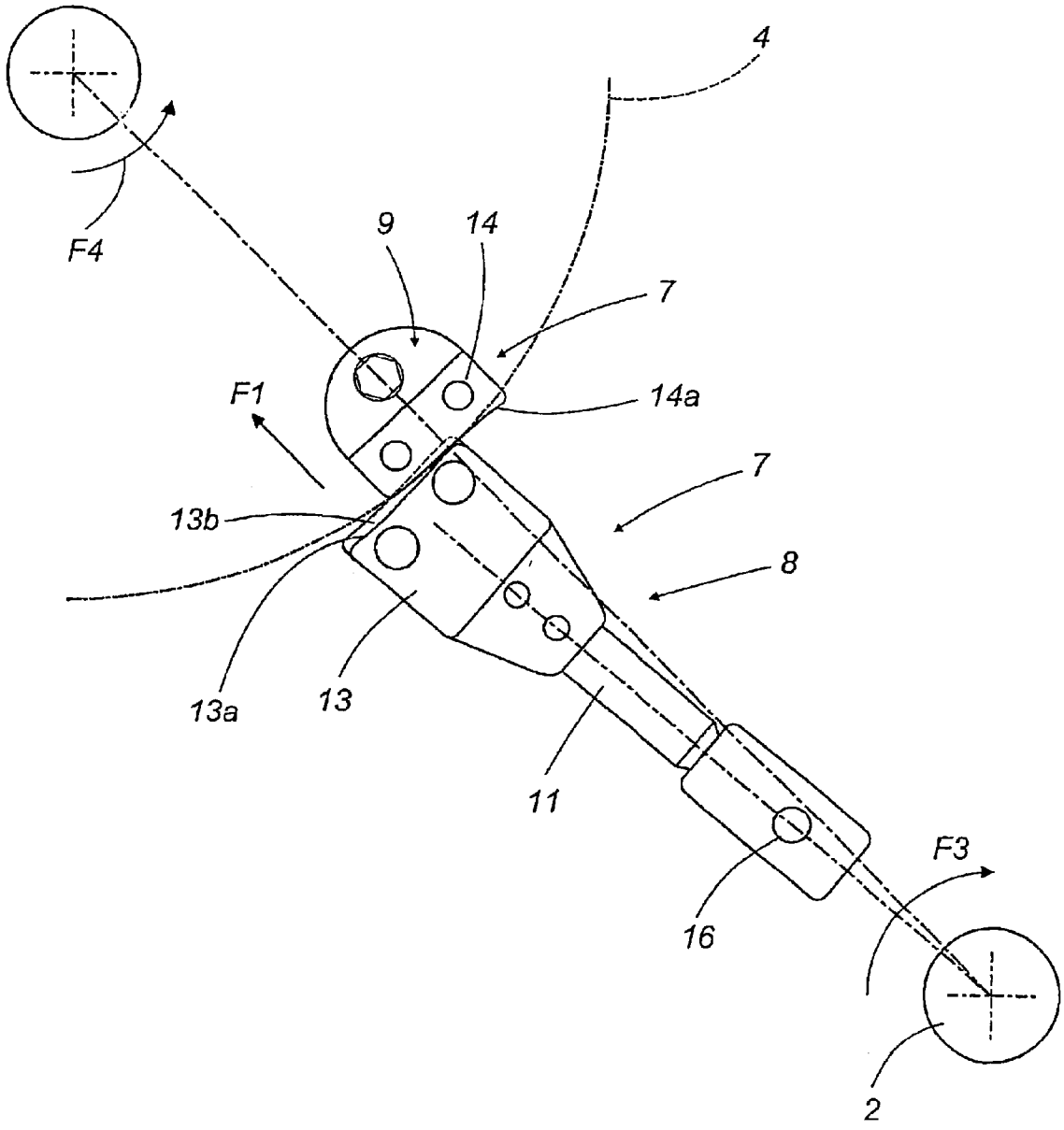
FIGS. 5 and 6 are schematic views of a detail of the capsule filling machine made according to the present invention in two successive operating positions.
Figure 6:
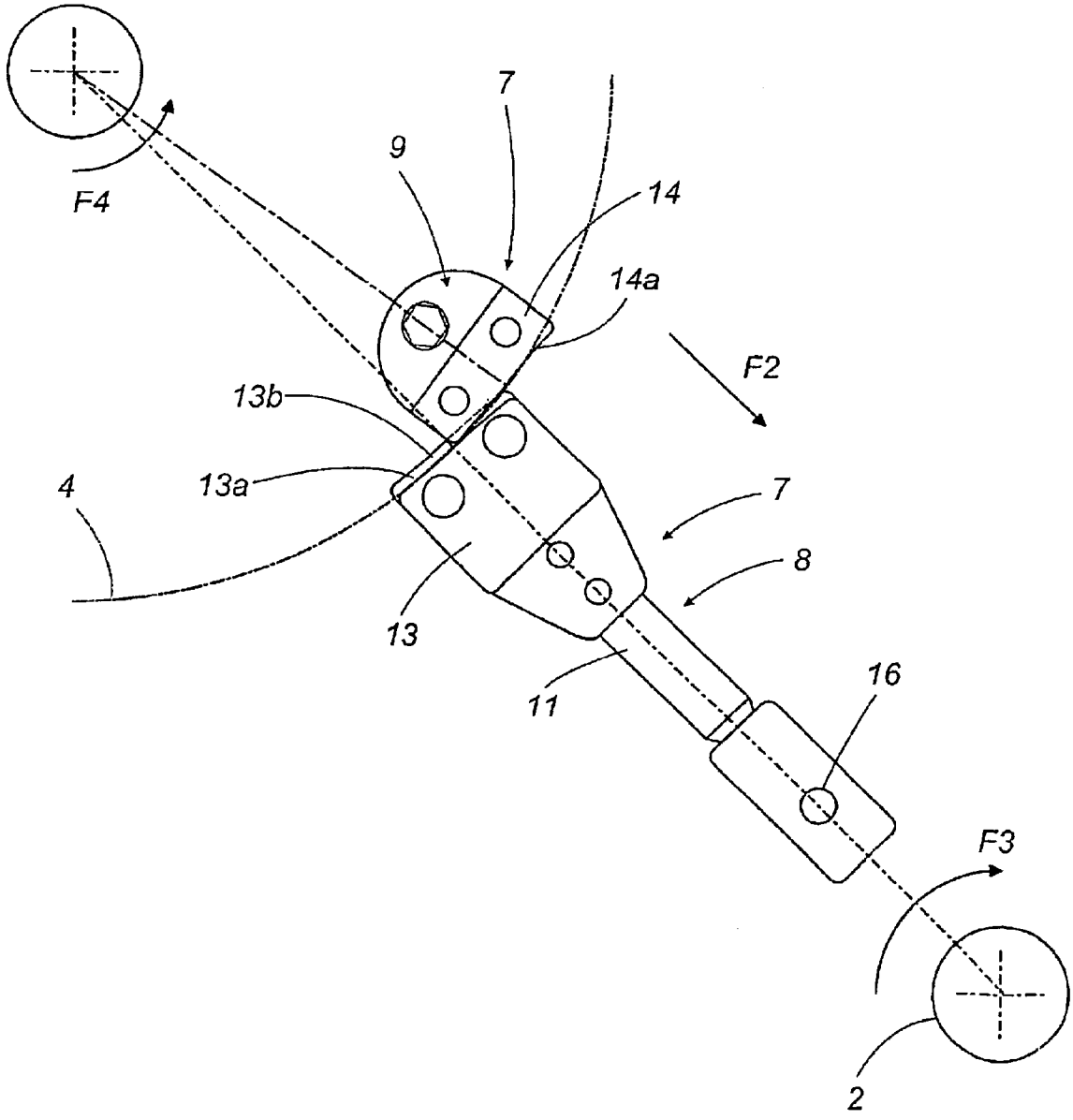

As illustrated in FIGS. 1, 2 and 3, the embodiment of the machine 1 comprises a first operating station 2 consisting of a turret 2 which rotates with intermittent motion relative to a vertical central axis and in a clockwise direction in FIG. 2, illustrated by the arrow F3, to carry the capsule bodies 3 grouped in pairs, (each capsule body 3 forming a first, lower part of a hard gelatine capsule C of the known type), to a second station 4 consisting of a drum 4 for dosing the pharmaceutical product. The drum 4 rotates with intermittent motion, substantially synchronised with the turret 2 in an anti-clockwise direction in FIG. 2, illustrated by the arrow F4.

As illustrated in FIG. 1, the turret 2 is at the centre of the machine 1, whilst other operating stations, arranged around the turret 2, preferably comprise a capsule C body 3 feed station 30; a capsule C presence check station 31 on the turret 2; a pellet or micro-tablet feed station 32; a liquid product feed station 33; the drum 4 or powdered product dosing station 4; a station 34 for closing the capsule bodies 3 with lids (not illustrated), each lid forming a second part of the capsule C and, finally, an outfeed station 35 for the closed capsules C obtained in this way.

According to an architecture known to experts in the field, the drum 4 has a plurality of cylindrical holes 5, inside each of which a known method is used to feed a dose 6 of product, released from a hopper of the known type and not illustrated by the action of known reciprocating pistons P (FIGS. 2 and 3). The dose of product is then released into a capsule body 3, as is explained more clearly below.

As illustrated in FIGS. 2 to 6, between the turret 2 and the drum 4 there are slide means 7 operating which form elements that support and contain each capsule body 3. The means 7 are designed to allow each capsule body 3 to be positioned below a lower end 5*a* of each cylindrical dosing hole 5 and, respectively, a capsule body 3 movement away from the cylindrical hole 5 once the dose 6 has been transferred into the capsule body 3.

More specifically, as is schematically illustrated in FIG. 2, the slide means 7 comprise a plurality of first slide supports 8 carried by the turret 2 and each supporting a pair of capsule bodies 3 positioned in bushes 15, and a plurality of second slide supports 9 carried by the drum 4.

For the sake of simplicity and without limiting the scope of application of the present invention, the description which follows refers to a single first slide support 8 on the turret 2 and to a single second slide support 9 on the drum 4. Moreover, again for simplicity, reference is made to a single capsule body 3 and a single cylindrical hole 5, although the machine 1 normally has a pair of capsule bases 3 in bushes 15 on each first slide support 8 and, therefore, a corresponding pair of cylindrical holes 5 on each support 9 on the drum 4.

As illustrated again in FIGS. 2 to 6, the first support 8 comprises an arm 11 extending radially from the turret 2 and on which the drive means 10 located in the turret 2 act.

The machine 1 also has cam drive means 10 of the known type, the means 10 acting on the arm 11 in such a way that, during the turret 2 stepping rotation, they generate a forward rototranslational motion of the first support 8 towards the second support 9, that is to say, a forward motion which is both radial and transversal/tangential, to gradually bring the support 8 into contact with the second support 9, with a simultaneous substantially radial thrust pushing the second support 9 backwards, described in detail below.

The first support 8 consists of the arm 11 and a supporting head 13 with at least one bush 15 holding the capsule body 3.

The arm 11 also has another seat 16, inside the turret 2, for connection to a cam follower pin 17 (and roller 17*a*), controlled by a cam profile 18 located inside the turret 2 and forming the above-mentioned drive means 10 for the first support 8.

The second support 9 is, in turn, connected to a ring-shaped auxiliary supporting element 12, part of the drum 4 and located below the cylindrical hole 5.

As is better illustrated in FIGS. 3, 4, 5 and 6, the second support 9 comprises an upper head 14 which, in an operating position closing the lower end 5*a* of the cylindrical hole 5, is below the end 5*a* (FIG. 3), and is attached to a lower body 19 connected to thrust means 20 (of the known type and illustrated with a dashed line in FIG. 3).

The thrust means 20 are protected by an expanding pleated cover 20*a* and are designed to keep the head 14 in the above-mentioned operating position, closing the end 5*a* and to counteract the thrust movement of the support 8 on the support 9 which moves the head 14 to a retracted operating position (FIG. 4—arrow F1), in which the head 14 is distanced from the end 5*a* of the cylindrical hole 5.

As is better illustrated in FIGS. 2, 3, 5 and 6, the heads 13 and 14 of the respective supports 8 and 9 have respective curved front surfaces 13*a* and 14*a*, shaped in such a way that they match one another when perfectly in contact and so that, in practice due to the radial and transversal motion, they facilitate a synchronised gradual backward movement of the second support 9 as a result of the gradual forward movement of the first support 8 until the head 13 makes contact with the head 14 of the support 9.

The configuration of the head 13 includes an end with a tapered profile 13*b*, at the front contact surface 13*a*. The profile 13*b* is designed to effectively and substantially connect without play to the contact surface 14*a* of the second support 9 which, in turn, has an undercut element 14*b* which makes contact with the profile 13*b*.

In practice, during machine 1 operation, there are the following steps for feeding and releasing a dose 6 of product into the capsule body 3: closing of the cylindrical hole 5, with the dose 6 inside it, by the head 14 of the second support 9 located below the lower end 5*a* of the cylindrical hole 5 (FIG. 3) in the end 5*a* closing operating position; a first support 8 gradual radial and transversal approach movement (FIG. 5) until its head 13 makes contact with the head 14 of the second support 9 thanks to the drive means 10 and a simultaneous synchronised backward movement of the head 14 to its retracted operating position relative to the hole 5 (FIGS. 2 and 4), with a consequent release of the dose 6 into the capsule body 3; a subsequent step of turret 2 and drum 4 rotation which moves the heads 13 and 14 of the supports 8 and 9 away from one another, facilitated by a slightly early rotation of the support 9 (FIG. 6) thanks to a small deliberate offset in the drum 4 rotation in direction F4 relative to the rotary movement of the turret 2 in direction F3.

In this way, the capsule C filling step in the machine 1, that is to say, the transfer of product doses 6 into the capsule bodies 3, occurs in an efficient and rapid way, greatly limiting the possibility that quantities of product will escape, dropping out and causing friction which damages the delicate slide support mechanisms 8 and 9.

The invention described can be subject to numerous modifications and variations without thereby departing from the scope of the inventive concept. Moreover, all the details of the invention may be substituted by technically equivalent elements.

What is claimed is:

1. A capsule filling machine (1) for the production of hard gelatine capsules (C) of the type with a capsule lid and a capsule body and containing a product, preferably a pharmaceutical product, the machine (1) comprising at least a first station (2) rotating with a stepping motion for supporting and moving at least one capsule body (3) to a second station (4) for feeding and dosing the product, the second station (4) rotating with a stepping motion synchronised with the first station (2) and having at least one cylindrical hole (5) for containing a dose (6) of the product; between the first station (2) and the second station (4) there being slide means (7) for supporting and moving the capsule body (3) between a first operation position, in which the capsule body (3) is distanced from a lower end **(5*a*) of the cylindrical hole (5), and a second operating position, in which the capsule body (3) is exactly below the lower end (5*a*) of the cylindrical hole (5), allowing the release of the dose of product (6) into the capsule body (3); the machine being characterised in that the slide means (7) comprise at least a first and a second support (8, 9) operating in conjunction with one another, said first support (8) being carried by the first station (2), rotating and supporting at least one capsule body (3); said second support (9) being carried by the second station (4), rotating and located, in the first operating position, below the end (5*a*) of the cylindrical hole (5) containing the dose (6), closing the end (5*a*); drive means (10) designed to act upon at least the first support (8), moving the first support (8) forward towards the second support (9) with both radial and transversal motion until the first support (8) gradually makes contact with the second support (9), with a consequent thrust motion of the first support (8) on the second support (9) pushing the second support (9) back from the first operating position to the second operating position, allowing the dose (6) to be released into the capsule body (3)**.

2. The machine according to claim 1, characterised in that the first and second supports (8, 9) have respective end heads (13, 14) with relative front surfaces **(13*a*, 14*a*)** which make contact with one another, shaped in such a way as to match each other perfectly.

3. The machine according to claim 1, characterised in that the first support (8) comprises an arm (11) extending radially from the first station (2), driven by the drive means (10) located in the first station (2) and acting on the arm (11).

4. The machine according to claim 3, characterised in that the arm (11) has another seat (16) for connection to a cam follower pin (17) controlled by a cam profile (18) and forming the first support (8) drive means (10).

5. The machine according to claim 4, characterised in that the second support (9) is connected to an auxiliary support element (12) which is part of the second station (4) and located below the cylindrical hole (5) which feeds the dose of product.

* * * * *